US011191139B2

(12) United States Patent
Otten

(10) Patent No.: US 11,191,139 B2
(45) Date of Patent: Nov. 30, 2021

(54) METHOD OF CONTROLLING AN LED SOURCE AND AN LED BASED LIGHT SOURCE

(71) Applicant: EldoLAB Holding B.V., Son en Breugel (NL)

(72) Inventor: Andy Johanna Elisabeth Otten, Wassenberg (DE)

(73) Assignee: eldoLAB Holding B.V., Son en Breugel (NL)

( * ) Notice: Subject to any disclaimer, the term of this patent is extended or adjusted under 35 U.S.C. 154(b) by 0 days.

(21) Appl. No.: 16/761,708

(22) PCT Filed: Nov. 13, 2018

(86) PCT No.: PCT/NL2018/050756
§ 371 (c)(1),
(2) Date: May 5, 2020

(87) PCT Pub. No.: WO2019/098825
PCT Pub. Date: May 23, 2019

(65) Prior Publication Data

US 2021/0185778 A1 Jun. 17, 2021

(30) Foreign Application Priority Data

Nov. 14, 2017 (NL) ..... 2019903

(51) Int. Cl.
*H05B 45/20* (2020.01)
*H05B 45/46* (2020.01)

(52) U.S. Cl.
CPC ..... *H05B 45/20* (2020.01); *H05B 45/46* (2020.01)

(58) Field of Classification Search
CPC ..... H05B 45/20; H05B 45/46
See application file for complete search history.

(56) References Cited

U.S. PATENT DOCUMENTS 9,144,136 B2 * 9/2015 Hong ..... H05B 47/10
2011/0291129 A1 12/2011 Wirth
(Continued)

FOREIGN PATENT DOCUMENTS

WO 2019098825 A1 5/2019

OTHER PUBLICATIONS

Written Opinion for International Application No. PCT/NL2018/050756, dated Mar. 21, 2019, 7 pages.
(Continued)

*Primary Examiner* — Minh D A
(74) *Attorney, Agent, or Firm* — RatnerPrestia

(57) ABSTRACT

An LED driver configured to power a plurality of LEDs having a different colour or colour spectrum is described, the LED driver comprising:

a power converter configured to supply power to the plurality of LEDs and a control unit, the control unit comprising:

an input terminal configured to receive an input signal representing a desired colour set-point;

a processing unit configured to:

determine a MacAdam ellipse for the desired colour set-point;

determine a required intensity or current for each of the plurality of LEDs so as to achieve the desired colour set-point;

determine a colour shift direction for the colour set-point, based on the determined required intensities or currents;

select a modified colour set-point based on the colour shift direction and the MacAdam ellipse;

determine a required supply current for each of the plurality of LEDs so as to achieve the modified colour set-point;

(Continued)

determine a control signal for the power converter so as to generate the required supply currents;

and wherein the control unit further comprises an output terminal for outputting the control signal to the power converter.

13 Claims, 7 Drawing Sheets

(56) References Cited

U.S. PATENT DOCUMENTS

| | | | | |
|---|---|---|---|---|
| 2011/0309755 | A1 | 12/2011 | Wirth et al. | |
| 2012/0038280 | A1* | 2/2012 | Zoorob | H01L 33/005 315/151 |
| 2013/0093361 | A1 | 4/2013 | Bertram et al. | |
| 2014/0167646 | A1* | 6/2014 | Zukauskas | H05B 45/20 315/297 |
| 2015/0084542 | A1* | 3/2015 | Chen | H05B 45/20 315/294 |
| 2017/0127485 | A1* | 5/2017 | Hsia | H05B 45/60 |

OTHER PUBLICATIONS

Search Report NL for Application No. NL 2019903 dated Jul. 10, 2018, and Written Opinion, 8 pages.

* cited by examiner

METHOD OF CONTROLLING AN LED SOURCE AND AN LED BASED LIGHT SOURCE

RELATED APPLICATIONS

This application is a U.S. National Phase Patent Application of International Application No. PCT/NL2018/050756, filed Nov. 13, 2018, which claims priority to Netherlands Application No. NL 2019903, filed Nov. 14, 2017, the disclosures of which are entirely incorporated herein by reference.

FIELD OF THE INVENTION

The invention relates to the field of LED sources, and more specifically to the control of multi-coloured LED sources.

BACKGROUND OF THE INVENTION

The present invention is about multi-coloured LED sources, e.g. comprising a plurality of LEDs having a different colour or colour spectrum. Such LED sources are typically operated by supplying a controlled current to the LED or LEDs of the LED source. Due to the supplied current, the LED or LEDs will generate light with an intensity depending on the supplied current. By adjusting the relative currents as supplied to the LEDs, and thus the intensities of the different LEDs, a desired colour set-point may be realised.

In case a desired colour set-point is to be generated, it is desirable that this set-point is realised as closely or accurately as possible and is maintained as long as needed.

Due to aging or unknown non-linear behaviour of components of the light source, the desired set-point, e.g. the desired colour of the generated light, may not be reached.

Alternatively or in addition, the actual colour as realised may not remain constant.

SUMMARY OF THE INVENTION

It is an object of the present invention to improve the accuracy at which a desired colour for a multi-coloured LED source is attained and maintained.

In accordance with a first aspect of the present invention, there is provided a method of controlling a plurality of LEDs having a different colour or colour spectrum, the method comprising:

- receiving a desired colour set-point;
- determining a MacAdam ellipse for the desired colour set-point;
- determining a required intensity or current for each of the plurality of LEDs so as to achieve the desired colour set-point;
- determining a colour shift direction for the colour set-point, based on the determined required intensities or currents;
- selecting a modified colour set-point based on the colour shift direction and the MacAdam ellipse;
- controlling the plurality of LEDs based on the modified colour set-point.

The present invention relates to LED based light sources, in particular LED based light sources comprising a plurality of multi-coloured LEDs, e.g. comprising a plurality of LEDs having a different colour or colour spectrum. Within the meaning of the present invention, a multi-coloured LED source may also encompass LED sources comprising a plurality of different white LEDs, i.e. white LEDs having a different colour temperature. As is known by the person skilled in the art, when a plurality of LEDs having a different colour or colour spectrum are combined in an LED source, the resulting colour of the light source as perceived can be modified by modifying the relative intensities of the available LEDs. The present invention provides in a method of controlling a plurality of such LEDs.

In a first step, the method according to the present invention comprises the step of receiving an illumination set-point, in particular a colour set-point that is to be achieved by the LED source. In general, an illumination set-point may e.g. comprise an intensity set-point, i.e. indicating a desired intensity and a colour set-point, indicating a desired colour or colour temperature. Such a colour set-point may thus represent a colour that is distinct from the colour that is generated by each of the individual LEDs of the light source. By an appropriate mixing of the available colours, one may however control the light source to generated the desired colour.

The control method according to the present invention further comprises the steps of determining a required intensity or current for each of the plurality of LEDs so as to achieve the desired colour set-point, and determining a MacAdam ellipse for the desired illumination set-point.

Based on the characteristics of the applied LEDs, e.g. their coordinates in the CIE chromaticity diagram, one may determine the required (relative) intensities to arrive at a desired colour and the desired total intensity of the plurality of LEDs combined. As an outcome of this step, one may also determine the required currents that need to be supplied to the plurality of LEDs, to obtain the desired intensities.

In accordance with the present invention, a MacAdam ellipse is further determined for the desired colour set-point. As is known to the person skilled in the art, a MacAdam ellipse is a region on the chromaticity diagram, which contains all colours which are indistinguishable, to the average human eye, from the colour at the centre of the ellipse. Various types of MacAdam ellipses have been defined and discussed in literature, such as a 2-step or 3-step or 4-step MacAdam ellipse, whereby the number of steps refers to the number of standard deviations a point on the boundary of the ellipse is removed from the desired colour set-point.

The control method further comprises the step of determining a colour shift direction for the colour set-point. Within the meaning of the present invention, such a colour shift direction represents a direction in which the actual achieved colour generated by the plurality of LEDs will shift to, in case the LEDs are powered to generate the required intensities. Within the meaning of the present invention, a colour shift direction may also be referred to as an expected colour mismatch. Various reasons for the occurrence of such a colour shift may be applicable, as will be explained in more detail below. In case a conventional LED power source, also referred to as an LED driver, is controlled to drive a plurality of different LEDs, based on a desired set-point, it may often be noticed that this desired set-point, e.g. a desired colour and intensity is either not realized or is not maintained. As indicated above, in case a desired colour set-point represents a colour that is not identical to the colour as generated by one of the available LEDs of the LED source, the desired colour set-point will need to be generated by finding the appropriate mix of the available colours. Such mixing of the available colours may be realised in practice by applying different currents to the different LEDs, thus controlling the contribution of each of the LEDs to the actual colour. There may be various causes why a desired illumination characteristic, in particular a desired colour may not be realised in practice.

1. An LED driver may e.g. assume that the intensity as generated by an LED is proportional to the current as supplied to the LED. In practice, this may not be the case.
2. The actual current as supplied by the LED driver to the LED may be different from the desired current, e.g. represented by a current set-point.
3. The generated intensity of an LED may further vary over time due to aging and
4. The generated intensity of an LED may further depend on the operating temperature of the LED.

In accordance with the present invention, one or more of these effects are considered and, based on this, one may determine or estimate a deviation between the desired colour set-point and the actual colour that can or will be realised. In particular, based on one or more of these effects, one may determine in which direction the generated colour of the LED source is most likely to shift and one may forecast, to a certain degree, what the actual colour will become, in case no measures are taken. Such a deviation between the expected or desired colour, e.g. represented by a colour set-point, and an actual obtained colour may e.g. be represented in the CIE chromaticity diagram as a colour shift in a particular direction.

In an embodiment of the present invention, the colour shift direction is based on an expected or estimated thermal behaviour of the LEDs. When an LED is supplied with a current, it will heat up to a certain temperature. Due to this elevated temperature, the generated illumination or intensity will typically be lower than expected. Further, it may be observed that such a mismatch between an expected illumination or intensity and an actual illumination or intensity will increase when the operating temperature of the LED or LED source increases.

As such, in an embodiment of the present invention, the control method comprises the step of determining a colour shift direction based on a thermal characteristic of the LEDs as applied. In such embodiment the method may comprise the steps of:

- determining a required intensity or current for each of the plurality of LEDs so as to achieve the desired colour set-point;
- determining, based on the determined required intensities or currents and a thermal characteristic of the LEDs, an expected temperature of the LEDs;
- determining, based on the expected temperatures of the LEDs, expected intensities for the LEDs; and
- determining, based on the expected intensities, and the known colour coordinates of the LEDs, what the actual colour as generated might become, in case no action is taken.

In such embodiment, a line connecting the desired colour set-point and the determined actual colour in the CIE diagram, may be considered to define a colour shift direction. Such colour shift direction may be used in the present invention, together with the MacAdam ellipse, to determine an adjusted or modified colour set-point that anticipates on the expected colour shift.

In accordance with the present invention, the control method thus anticipates on this expected shift in colour or deviation by selecting, based on the colour shift direction and the MacAdam ellipse, a modified illumination set-point, in particular a modified colour set-point. As an example, a modified colour set-point may be selected which is removed from the desired illumination set-point in a direction that is opposite the determined or estimated colour shift direction and which is still within the MacAdam ellipse. Once such a modified colour set-point is determined, this modified colour set-point can be applied to power the plurality of different LEDs. As a result, the actual illumination characteristic that is realised, in particular the actual colour characteristic will adhere more closely to the desired colour characteristic. Further, the actual colour characteristic, at least as perceived by a human observer, may be maintained for a longer period.

In accordance to a second aspect of the present invention, there is provided an LED driver configured to power a plurality of LEDs having a different colour or colour spectrum, the LED driver comprising:

- a power converter configured to supply power to the plurality of LEDs and
- a control unit, the control unit comprising:
  - an input terminal configured to receive an input signal representing a desired colour set-point
  - a processing unit configured to:
    - determine a MacAdam ellipse for the desired colour set-point;
    - determine a required intensity or current for each of the plurality of LEDs so as to achieve the desired colour set-point;
    - determine a colour shift direction for the colour set-point, based on the determined required intensities or currents;
    - select a modified colour set-point based on the colour shift direction and the MacAdam ellipse;
    - determine a required supply current for each of the plurality of LEDs so as to achieve the modified colour set-point;
    - determine a control signal for the power converter so as to generate the required supply currents;
  - and wherein the control unit further comprises an output terminal for outputting the control signal to the power converter.

The method of operating a plurality of multi-coloured LEDs according to the present invention may be realised by an LED driver according to the present invention. Such an LED driver may comprise a power converter configured to supply the required power to the plurality of LEDs. In an embodiment, such a power converter may comprise a switched mode power converter such as a Buck, Boost, or flyback converter.

In an embodiment, such a power converter may be configured to output a plurality of controlled currents, whereby each of said currents may be used to power an LED of the plurality of LEDs.

These and other aspects of the invention will be more readily appreciated as the same become better understood by reference to the following detailed description and considered in connection with the accompanying drawings in which like reference symbols designate like parts.

BRIEF DESCRIPTION OF THE DRAWINGS

FIG. 4(*b*) schematically depicts an intensity vs. temperature graph of an LED.

DETAILED DESCRIPTION OF EMBODIMENTS

In multi-coloured LED sources, a particular desired colour set-point may be realised by controlling the relative intensities of the different LEDs of the LED source. Whether or not a particular desired colour set-point may be realised with a particular set of LEDs, may e.g. be assessed by considering the position of the set of LEDs in a chromaticity diagram such as the CIE 1931 chromaticity diagram.

Such a chromaticity diagram can be used to characterize particular LEDs, e.g. by attributing the coordinates (x, y) of the colour of a particular LED in the chromaticity diagram to the particular LED.

In an embodiment, the present invention may be applied to control a set of three different LEDs. As an example, such LEDs may e.g. respectively emit green light, blue light and red light. Such light sources may e.g. be represented by their (x,y) coordinates in the chromaticity diagram.

Figure 1:
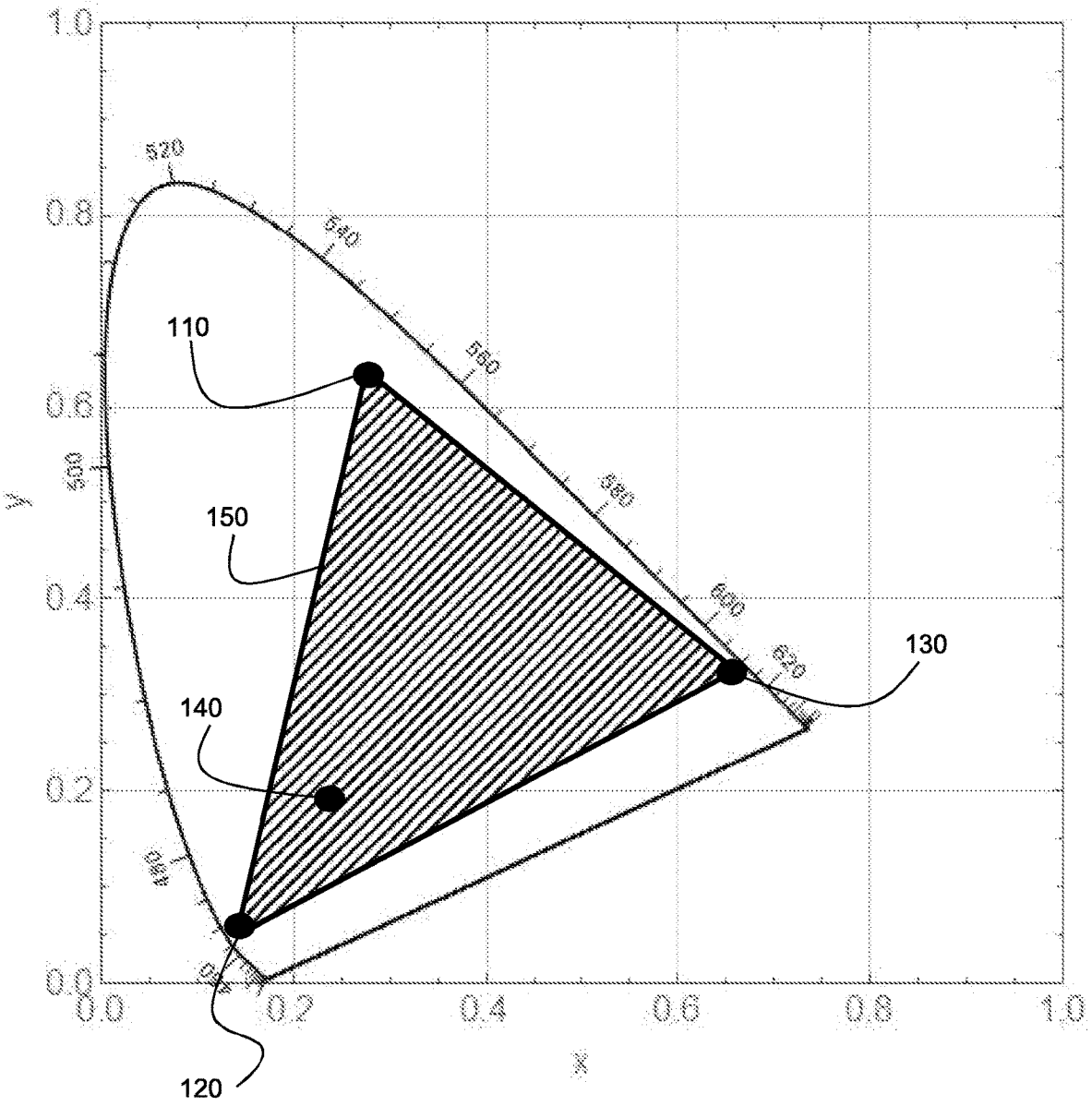
FIG. 1 schematically depicts a CEI chromaticity diagram and a range of colours or gamut that can be generated by three LEDs.

FIG. 1 schematically depicts such a CIE chromaticity diagram and (x,y) coordinates of three LEDs, a green LED 110, a blue LED 120 and a red LED 130.

By operating these three LEDs, e.g. at varying intensities, any colour within the triangle 150 formed by the three coordinate pairs can be realised. As an example, coordinates 140 can e.g. represent a desired colour set-point. When the CIE coordinates of the available LEDs, e.g. LEDs 110, 120, 130 and the desired colour coordinates 140 are known, one may determine the required (relative) intensities (Y) to be applied to the available LEDs, to arrive at a desired colour set-point. Various methods have been described in literature to arrive at these intensities, referred to as colour mixing algorithms, such algorithms e.g. making use of the tristimulus values of a colour.

As such, it is generally known how to derive, starting from a set of LEDs having known coordinates in the CIE diagram, the required intensities of the LEDs to arrive at a desired colour set-point.

For the given example in FIG. 1, one may easily acknowledge that, in order to arrive at the colour set-point 140 using LEDs 110, 120 and 130, the main contribution will be made by LED 120 which has a colour that is closest to the desired colour set-point.

In practice, it may however be difficult to either arrive at the desired colour set-point or to maintain the desired colour set-point, e.g. due to aging or a temperature rise. Alternative or in addition, the power supply that is used to drive the LEDs may also attribute to such difficulties in case an actual current that is generated would not correspond to the desired current. Such a power supply is generally referred to as an LED driver. Such an LED driver may e.g. be configured to supply a DC current or a modulated current, e.g. a PWM modulated current, to an LED or to a plurality of LEDs. In addition, it may be difficult to predict an illumination characteristic, e.g. an intensity of a particular LED for a given current or modulated current that is supplied to the LED. Further, an output characteristic of an LED is known to vary over time, e.g. due to aging.

The present invention aims to mitigate these effects by proposing an alternative manner to arrive at a desired illumination set-point, in particular a desired colour set-point. In an embodiment of the present invention, the following steps are taken to control an LED based light source having a plurality of LEDs having a different colour or colour spectrum:

In a first step, a desired colour set-point is received. Such a colour set-point may e.g. be provided, using a user interface, to an input terminal of a control unit of an LED driver that is configured to drive the plurality of LEDs of the LED based light source.

Based on the desired colour set-point, such a control unit may determine, in a second step, a MacAdam ellipse with the desired illumination set-point as its centre. A MacAdam ellipse is a region on the chromaticity diagram, e.g. the CIE diagram as shown in FIG. 1, which contains all colours which are indistinguishable, to the average human eye, from the colour at the centre of the ellipse. The contour of the ellipse therefore represents the just noticeable differences of chromaticity or colour. Various MacAdam ellipses may be defined, such as 2-step or 3-step MacAdam ellipses, whereby the number of steps refers to the number of standard deviations a point on the boundary of the ellipse is removed from the desired colour set-point.

Figure 2:
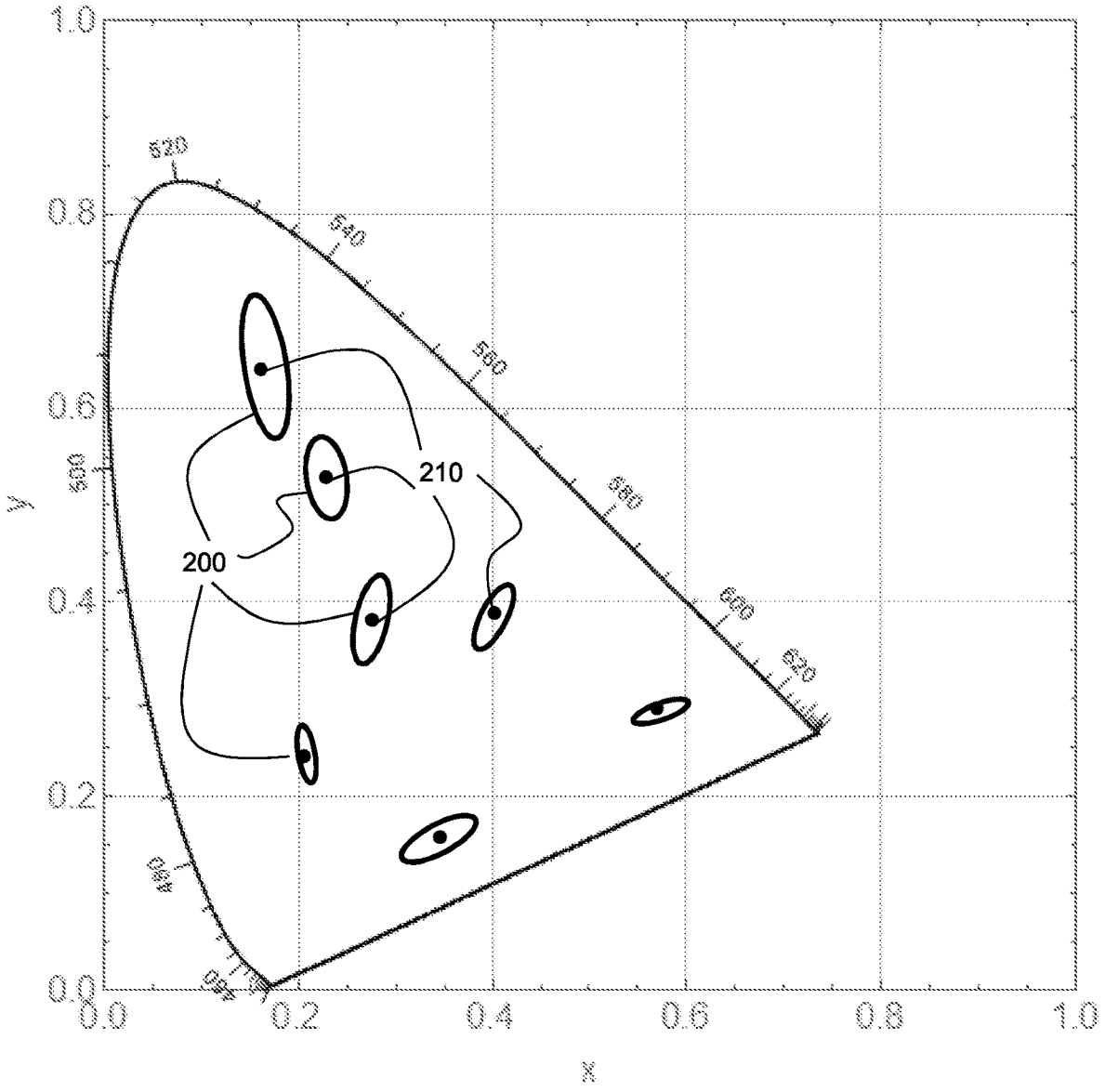
FIG. 2 schematically depicts a CEI chromaticity diagram and several MacAdam ellipses.

FIG. 2 schematically depicts a CIE diagram and a plurality of MacAdam ellipses 200 construed for different illumination or colour set-points 210.

The control method according to the present invention further comprises, as a third step, the determining of a required intensity or current for each of the plurality of LEDs so as to achieve the desired colour set-point.

Note that it can be pointed out that steps two and three do not need to be performed in a particular order.

It may further be pointed out that, based on the desired colour set-point, and having knowledge of the characteristics of the available LEDs, one may also determine directly the required currents that are to be supplied to the respective LEDs to obtain the colour set-point.

This may e.g. be realised using the tristimulus values X,Y,Z or the chromaticity values x and y and the Y tristimulus value.

As such, the third step as applied in the control method according to the present invention may also be to determine the required currents for each of the plurality of LEDs, so as to achieve the desired colour set-point.

Note that such determination would typically be done under the assumption that the generated intensity of an LED is proportional to the supplied current to the LED. In general, thermal effects would not be considered either when determining the required currents for a desired intensity.

In a next, e.g. fourth step, the control method according to the present invention provides in determining a colour shift direction for the desired illumination set-point, based on the determined required intensities or currents.

As indicated above, in general, it may be difficult to either arrive at a desired colour set-point or to maintain the desired colour set-point. As indicated above, the required intensities or currents as determined would typically be determined using assumptions that may not occur in practice. Such assumptions may e.g. be that the intensity as generated is linearly proportional with the supplied current or that a generated intensity of an LED is independent of an operating temperature of the LED. Based on the determined intensities or currents that are to be generated by the plurality of LEDs of a LED based light source in order to arrive at such a desired colour set-point, combined with considerations on the actual behaviour of an LED or LED driver, one may determine in which direction the output colour of the light source would shift, in case the LED driver would actually be controlled based on the determined intensities or currents. Phrased differently, when, in practice, an LED driver is controlled based on the determined currents or intensities, one would not arrive at the desired colour, i.e. represented by the desired colour set-point, but rather, one would arrive at a different actual colour. This difference may e.g. be represented in a CIE chromaticity diagram and may be considered a colour shift or colour mismatch.

One possible cause of such an occurring mismatch may be a non-linear relationship between a supply current to an LED and a generated intensity by the LED.

Another possible cause of such an occurring mismatch may be a temperature dependency of the generated intensity by an LED.

Yet another possible cause of such an occurring mismatch may be a non-linear relationship between a desired intensity set-point and the actual intensity that is realised.

Figure 3:
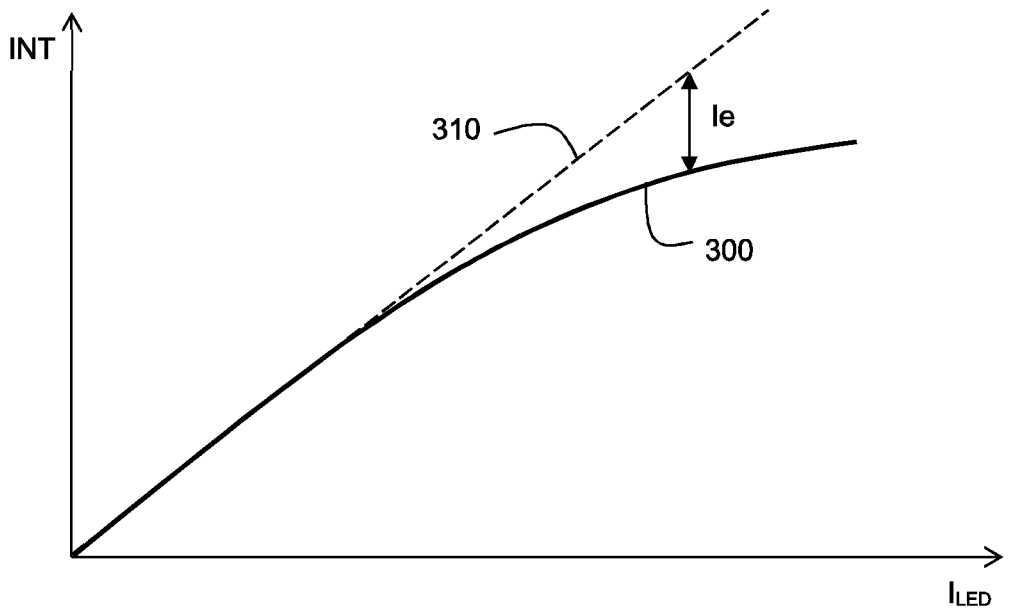
FIG. 3 schematically depicts a current vs. intensity characteristic of an LED.

FIG. 3 schematically depicts a possible non-linear relationship 300 between the current $I_{LED}$ as supplied to an LED and the intensity INT as outputted by the LED.

As can be seen, at comparatively low current levels, there is a proportionality between the current $I_{LED}$ as applied and the intensity INT, whereas, at comparatively high current levels, this proportionality is lost and the intensity INT as obtained is smaller than would be expected based on the initial slope, indicated by the dotted line 310, of the characteristic.

Other characteristics of LED or LED drivers that may adversely affect maintaining a desired illumination characteristic or set-point are aging or temperature effects.

It is known that LEDs suffer from aging, whereby, during the lifetime of an LED, the intensity as generated for a given current will diminish.

Further, it is generally known that the intensity of an LED diminishes when the temperature increases.

In general, there may thus be various causes why a desired illumination set-point may not be realised in practice.

Figure 4:
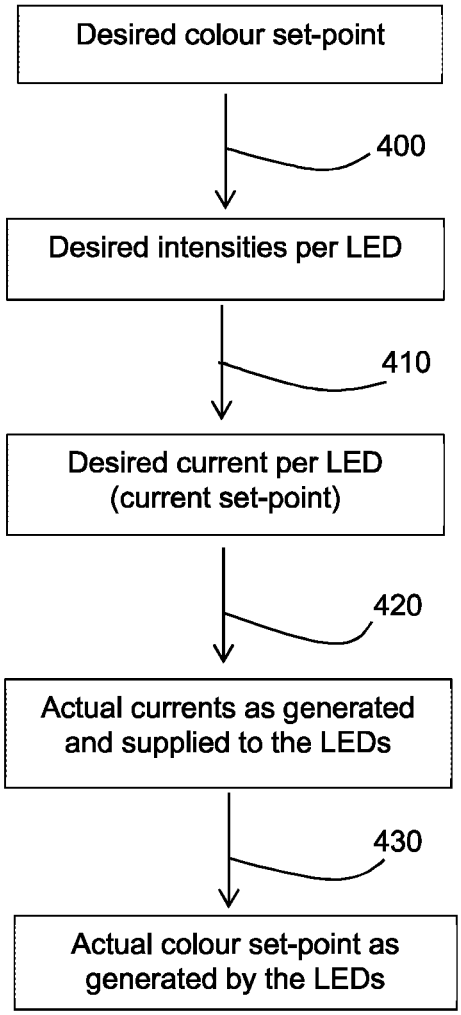
FIG. 4(*a*) schematically depicts a flow-chart of the process of obtaining an actual colour set-point.
Figure 4:
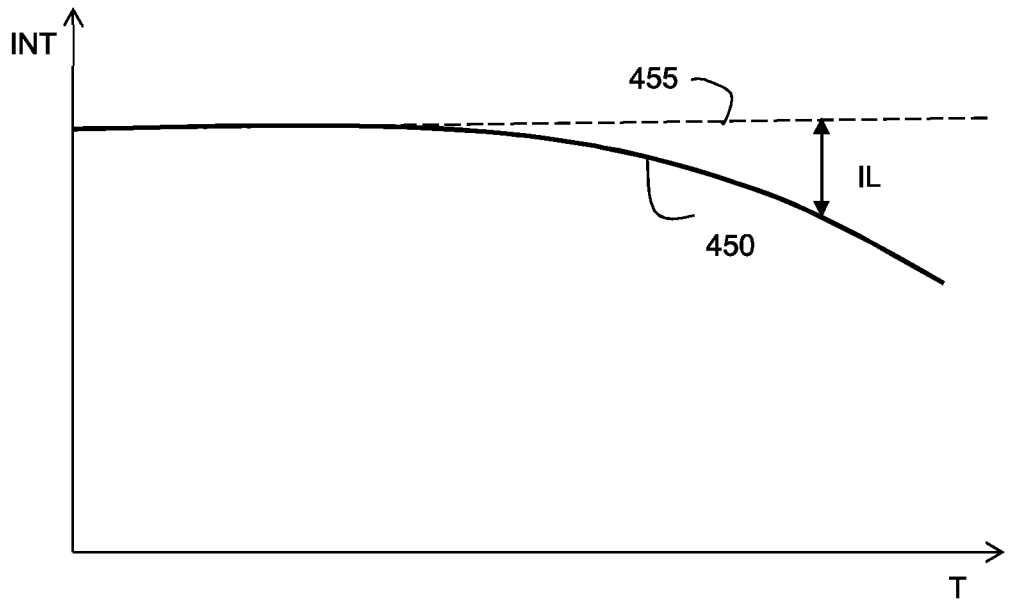

FIG. 4(*a*) schematically shows a flow-chart of a typical process from a desired colour set-point to an actual colour set-point.

The depicted process to go from a desired illumination set-point to an actual illumination set-point comprises a first step 400 of converting a desired illumination set-point to desired intensities for each of the LEDs involved. This conversion may e.g. be realised using the chromaticity coordinates x, y of the available LEDs.

In a second step 410, the process comprises the conversion from the desired illumination values for the LEDs to the desired (or required) currents for each of the LEDs. Typically, such a conversion is performed under the assumption that there is a linear correlation between the intensity as generated by an LED and the current through the LED.

In practice however, the intensity as generated may be, as e.g. illustrated in FIG. 3, be less than proportional to the current as supplied to the LED.

As such, when the currents as determined (using a linear relationship between current and intensity) would be applied in practice, the desired illumination, as represented by the desired illumination set-point, might not be reached. In particular, the obtained intensity would be lower, since the generated intensity per LED will be lower than expected and, in addition, the desired colour may not be reached. This can be understood as follows: Based on the intensity vs. current characteristic as shown in FIG. 3, one can deduce that the intensity error Ie as shown, i.e. the difference between the actual intensity 300 and the expected or theoretical intensity 310 increases when the current I increases. As such, an LED which is powered by a comparatively large current will have a comparatively large intensity error Ie, whereas an LED which is powered by a comparatively small current will have a comparatively small intensity error Ie. As will be illustrated in more detail, when the actual intensities as generated by the LEDs deviate from the required intensities, required to generate a desired colour, a different, deviating colour will be generated.

In a third step 420, the desired current set-point may be provided to an LED driver which is configured to generate the desired current and supply it to the LED or LEDs.

Typically, an LED driver will be configured to generate a current at different levels, in order to realise an illumination with different intensities. Such a current vs. intensity characteristic of an LED driver may e.g. be referred to as a dimming characteristic. Such a dimming characteristic will typically be non-linear, as will be illustrated below.

In a fourth step 430, the actual supplied current will be converted, by the LED, to an actual intensity. Also this conversion may in practice result in an actual intensity that is different from an expected intensity. Such difference may e.g. be attributed to thermal effects or aging effects. In particular, it is known that the generated intensity of an LED depends on the operating temperature of the LED; an LED will typically have a lower intensity at an elevated temperature.

FIG. 4(*b*) schematically shows a graph 450 illustrating the generated intensity of an LED (at a fixed current) as a function of temperature T. As can be seen, the higher the temperature T, the larger the deviation IL, indicative for an intensity loss, between a nominal intensity of the LED, indicated by the dotted line 455, and the actual characteristic.

In a similar manner, due to aging, an LED may not generate the expected intensity due to aging; the more operating hours an LED has had, the lower the generated intensity will typically be.

As such, based on such thermal or aging characteristics of the applied LEDs, a mismatch between the actual colour that is achieved and the desired colour set-point may result.

In an embodiment, a thermal characteristic or model of the LEDs of the light source may be used to assess, in a qualitative or quantitative manner, which LED or LEDs will be most affected by a temperature increase associated with the applied current through the LED or LEDs. Based on this knowledge, one may determine or estimate a temperature effect on the generated intensity of the LED or LEDs, i.e. one may determine or estimate what the actual intensity of the LED or LEDs would be when a certain current is applied. Subsequently, one may estimate, e.g. using the CEI diagram, the effect of these actual intensities on the generated colour. As will be appreciated by the skilled person, in case the actual intensities of the available LEDs will not correspond to the required intensities, the required intensities being required to obtain a particular colour, this would result in a different deviating colour to be generated. In accordance with the present invention, such a deviation, in particular the direction in which the colour is most likely to deviate, is determined or estimated and used to determine a modified colour set-point.

Figure 5:
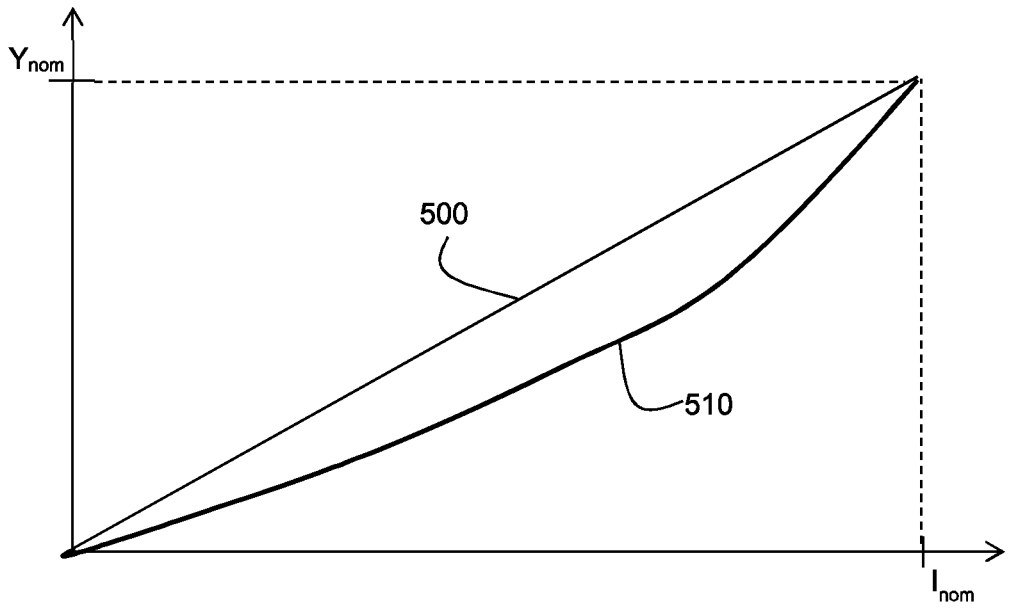
FIG. 5 schematically depicts a dimming characteristic of an LED driver.

As mentioned, when a desired (relative) intensity is to be realised by the plurality of LEDs, this may be realised by controlling an LED driver using a dimming set-point, indicative of a desired intensity for an LED, e.g. expressed as a % of a nominal intensity Ynom. Typically, a dimming characteristic of an LED driver may be either a linear characteristic or a non-linear characteristic. Examples of the latter may e.g. be quadratic or logarithmic characteristics. FIG. 5 schematically shows an example of such a linear characteristic dimming characteristic 500, indicating the generated intensity Y as a percentage of a nominal intensity Ynom, vs. the generated current I, as a % of the nominal current Inom. In practice however, it may occur that the actual current as generated by an LED driver does not correspond the required current, resulting in a deviation in the expected intensity. In FIG. 5, the actual dimming characteristic 510 deviates from the theoretical, linear, characteristic 500. In the embodiment as shown, there is thus a non-linear relationship between the intensity or current set-point (indicated as a % of the nominal current $I_{nom}$) and the actual generated intensity (indicated as a % of the intensity $Y_{nom}$ at the nominal current $I_{nom}$). As such, the desired (relative) intensities as required to obtain a particular colour set-point may not be realised in practice, resulting in a mismatch between the actual colour generated and the desired colour set-point. Similar deviations or mismatches may occur when a non-linear dimming characteristic is applied or implemented in an LED driver.

In accordance with the present invention, a modified colour set-point is generated to anticipate on such a mismatch. In particular, in accordance with the present invention, an expected colour shift is anticipated and taken into account in the control of the LEDs of the light source. Such an approach provides in the advantage that no actual measurement is needed (which could be used as feedback) to mitigate the colour shift.

Figure 6:
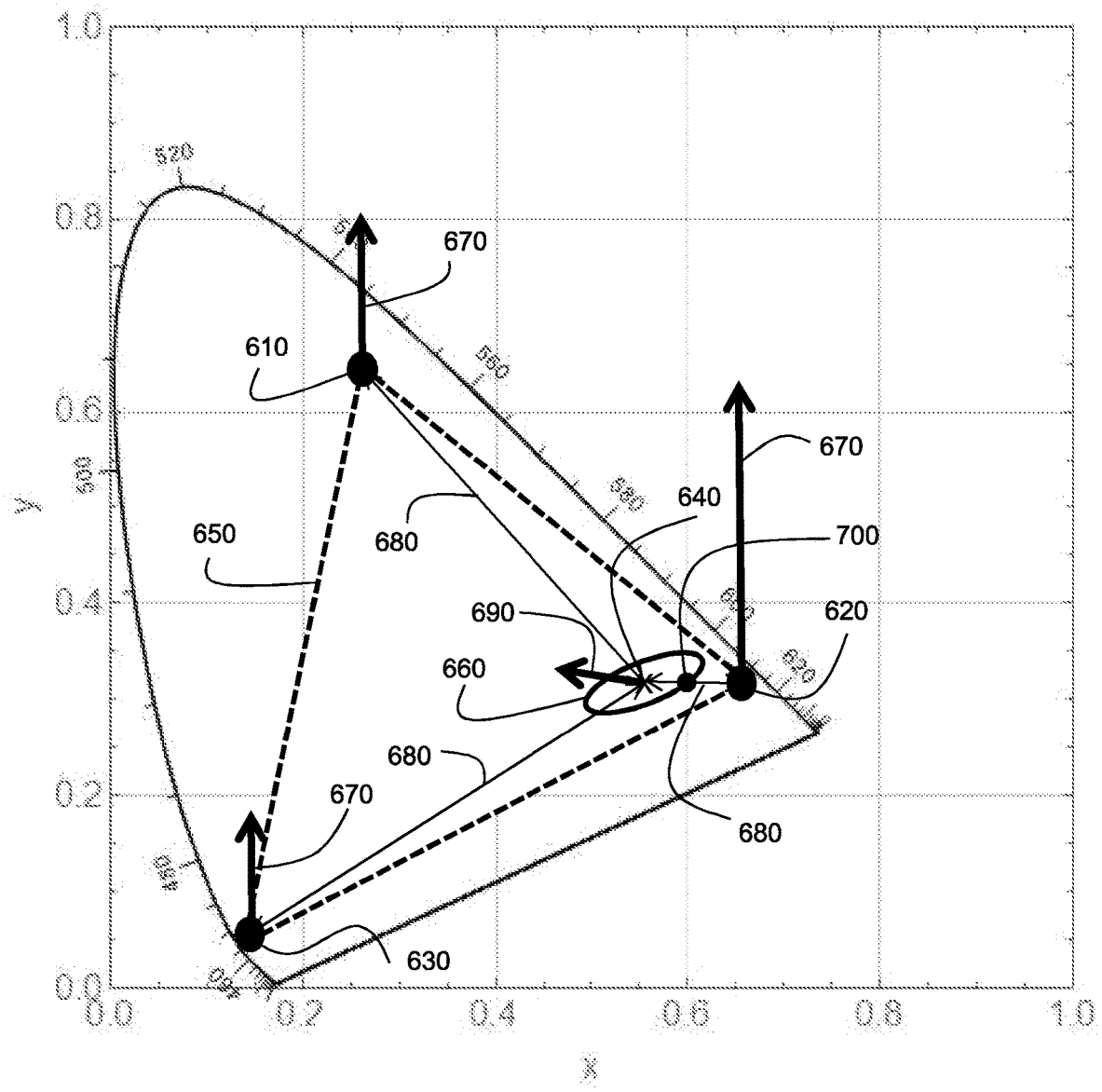
FIG. 6 schematically depicts a CEI chromaticity diagram, an intensity distribution over 3 LEDs and a colour shift direction based on the intensity distribution.

In an embodiment, the anticipated colour shift or colour shift direction may e.g. be determined based on the currents through the LEDs or intensities of the LEDs that are required to generate a desired colour. Typically, in order to obtain a desired colour set-point, the LEDs of an LED source will have to be operated at different intensity levels, and thus different currents. Under the assumption that the Such an anticipation can be realised in various manners as will be explained with respect to FIG. 6. FIG. 6 schematically depicts a CIE chromaticity diagram and (x,y) coordinates of three LEDs, a green LED 610, a blue LED 630 and a red LED 620.

By operating these three LEDs, e.g. at varying intensities, any colour within the triangle 650 formed by the three coordinate pairs can be realised. As an example, coordinates 640 can e.g. represent a desired colour set-point. FIG. 6 further shows, somewhat exaggerated in size, the MacAdam ellipse 660 for the desired colour set-point 640. In FIG. 6, the arrows 670 schematically represent the required intensities of the LEDs 610, 620, 630 in order to obtain the desired colour mixing of the colour set-point 640. As can be acknowledged by the skilled person, the LED who's coordinates are the closest to the desired colour set-point will have the largest contribution. As such, the arrow 670 associated with LED 620 is the largest, as the x,y coordinates of LED 620 in the CEI diagram are closest to the coordinates of the desired colour set-point.

FIG. 6 further schematically shows the distances 680 between the coordinates of the LEDs 610, 620 and 630 and the desired colour set-point in the CEI diagram.

FIG. 6 further schematically shows a colour shift direction, arrow 690, indicating in which direction a colour mismatch, as discussed above, is most likely to occur.

In an embodiment, of the present invention, the colour shift direction is based on the (relative intensities required to generate the desired colour set-point 640. The direction 690 may e.g. be taken along the line connecting the coordinates of the desired colour set-point with the coordinates of the LED having the highest intensity 670 and pointing away from the coordinates of the LED having the highest intensity 670. This direction 690 can be considered an estimation of a likely or most likely direction in which a colour shift would occur. The validity of such an estimation can e.g. understood under the assumption that the LED having the highest intensity may be supplied with the highest (relative) current and would heat up the most. In view of the typical temperature vs. intensity characteristic of an LED, as e.g. shown in FIG. 4(*b*), the LED that is heated up the most will most likely have the largest deviation w.r.t. generated intensity. As such, an colour shift direction based on the LED that is to generate the highest intensity, may be a good estimation of an occurring colour shift. Alternatively, a weighted combination of different directions, e.g. along lines connecting the coordinates of the desired colour set-point with the coordinates of each of the LEDs may be considered as well, whereby the intensities are applied as weight coefficients. Instead of being based on the intensities, the colour shift direction may also be determined based on the required currents for generating the intensities 670.

In a similar manner, the colour shift direction may be determined based on the distances between the LED coordinates and the desired colour set-point coordinates. One can consider these distances to be inversely proportional to the required intensities 670 and apply similar ways to define the colour shift direction 670.

By the above described methods, the colour shift direction will typically point away from the LED that contributes the most to the intensity. When considering that this LED will most likely operate at the highest temperature, and will age the fastest, one can indeed deduce that a colour mismatch will indeed most likely occur along this direction.

Note that the above described ways of determining the colour shift direction assume a correlation between the required intensity or current and the temperature of the LED. In case the different LEDs would have different thermal characteristics, these can be taken into account as well. Similarly, in case the number of LEDs available for each colour is different, this can be taken into account as well. As an example, in case there would be one LED 610, one LED 630 and two LEDs 620, each of the two LEDs 620 would only have to supply half of the intensity 670, in which case LED 610 would be operated at the highest temperature.

When the colour shift direction 690 and the MacAdam ellipse are known, one may determine a modified colour set-point, taking account of the direction in which the colour is most likely to shift and the MacAdam ellipse. In an embodiment, one may e.g. select the modified colour set-point along an opposite direction from the colour shift direction, e.g. along the line connecting the coordinates of the LED 620 and the desired colour set-point coordinates 640. The modified colour set-point may e.g. be selected as the crossing 700 of this line with the MacAdam ellipse. In accordance with the present invention, the actual temperature or the actual amount of aging need not be known. Rather, it is sufficient to know a likely or most likely direction of colour shift, and select an adjusted set-point based on this. In particular, with reference to FIG. 6, the modified set-point 700 can be considered a set-point that represents a low risk compensation for a colour shift that is likely to occur or will occur in the future. When the MacAdam ellipse is a 1 step to 3 step MacAdam ellips, then a set-point 700 will still theoretically (that is in the ideal case) yield a color within the MacAdam ellips while when no to some extent of shift has occurred it will still fall within the MacAdams ellipse until temperature and/or aging are so high that the MacAdamps ellips is left at the other end of the ellips then 700 and along the direction.

By operating a multi-coloured LED source in accordance with the present invention, a desired colour set-point may be more accurately obtained and maintained. By operating an LED source in a modified colour set-point that is e.g. selected in a direction opposite a most likely colour shift direction, an actual colour shift, during operation of the LED source will remain unnoticed by a human observer for a longer time, since the actual colour as generated will remain longer within the MacAdam ellipse of the desired colour set-point.

The present invention thus uses, in an embodiment, general tendencies in the behaviour of LED light sources to predict an amount and/or direction of a colour shift and uses this prediction or anticipates on this prediction to compensate for it, in advance. These compensations rely thus partially on uncertainty w.r.t. a forecasted, deviant behaviour and aim to obtain a colour with a prolonged correctness, i.e. the colour as perceived by a human observer will math longer with a desired colour set-point. Using the approach as proposed, the additional costs of sensors, e.g. colour or intensity sensors, in a light source can be avoided. As such, the method as proposed by the present invention can be considered to solve the following problem: How to avoid additional costs and still prolong a required colour accuracy as perceived by a human observer, as delivered by an LED based light source.

In an embodiment, the present invention provides in an LED driver, in particular an LED driver that is configured to power a plurality of LEDs having a different colour or colour spectrum.

Figure 7:
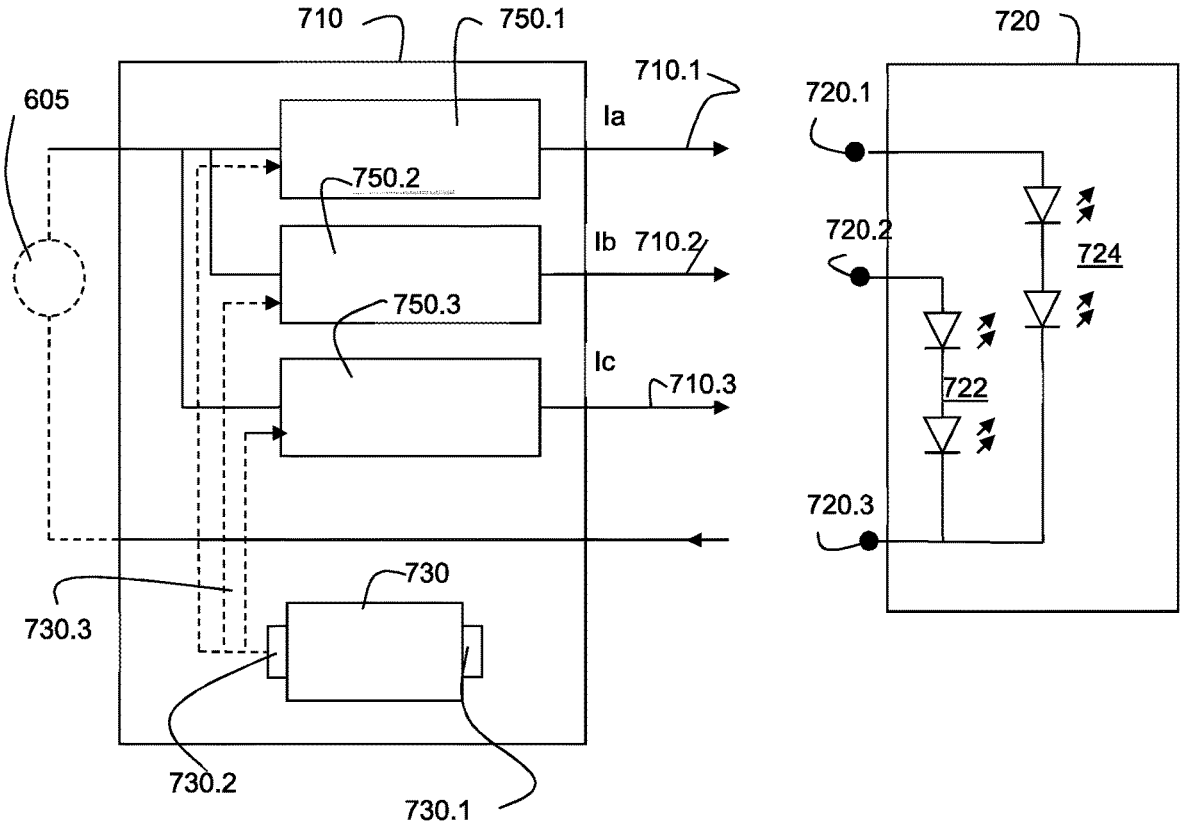
FIG. 7 schematically depicts an LED driver according to the present invention.

In an embodiment, as schematically shown in FIG. 7, such an LED driver 710 may comprise a power converter or power converters 750.1, 750.2, 750.3, configured to supply power to the plurality of LEDs, and a control unit 730.

In the embodiment as shown, the control unit 730 comprises an input terminal configured to receive an input signal 730.1, e.g. representing a desired colour set-point. In accordance with the present invention, the control unit may comprises a processing unit, e.g. a processor or microprocessor or microcontroller that is configured to:

- determine a MacAdam ellipse for the desired colour set-point;
- determine a required intensity or current for each of the plurality of LEDs so as to achieve the desired colour set-point;
- determine a colour shift direction for the colour set-point, based on the determined required intensities or currents;
- select a modified colour set-point based on the colour shift direction and the MacAdam ellipse;
- determine a required supply current for each of the plurality of LEDs so as to achieve the modified colour set-point; and
- determine one or more control signals 730.3 for the power converter or power converters 750.1, 750.2, 750.3, so as to generate the required supply currents;

In the embodiment as shown, the control unit 730 further comprises an output terminal 730.2 for outputting the control signals 730.3 to the power converters 750.1, 750.2, 750.3.

In an embodiment, the LED driver according to the present invention comprises one or more power converters, e.g. switched mode power converters such as Buck or Boost converters. During use, the LED driver 710 may e.g. be connected to a light source 720 comprising two LED groups 722 and 724, each group e.g. generating a different colour or colour spectrum. In the embodiment as shown, the LED driver 710 may be configured to output three currents Ia, Ib, Ic, at respective output terminals 710.1, 710.2 and 710.3, the output currents being provided by three power converters, e.g. switched mode power converters, 750.1, 750.2 and 750.3 of the LED driver. In the embodiment as shown, the output terminals 710.1, 710.2 of the LED driver 710 may be connected to the input terminals 720.1, 720.2 of the light source 720 to power the LED groups 724 and 722. As such, in the embodiment as shown, currents Ia and Ib of the LED driver may be provided, to LED groups 722 and 724 of the light source.

In an embodiment, the intensity of the light as generated by the different LEDs of the light source can be controlled, as understood by the skilled person, by adjusting or modulating the amplitude of the current, e.g. currents Ia, Ib as supplied to the LEDs. Such an adjusting or modulating may e.g. include merely adjusting an amplitude of the supplied current, and/or applying a modulation scheme such as pulse width modulation or the like to the supplied current, in order to adjust the intensity of the generated light.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

A single processor or other unit may fulfil the functions of several items recited in the claims.

The terms program, software application, and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

The invention claimed is:

1. A method of controlling a plurality of LEDs having a different colour or colour spectrum, the method comprising:
   receiving a desired colour set-point;
   determining a MacAdam ellipse for the desired colour set-point;
   determining a required intensity or current for each of the plurality of LEDs so as to achieve the desired colour set-point;
   determining a colour shift direction for the colour set-point, based on the determined required intensities or currents;
   selecting a modified colour set-point based on the colour shift direction and the MacAdam ellipse;
   controlling the plurality of LEDs based on the modified colour set-point,
   wherein the modified colour set-point is selected in an opposite direction from the colour shift direction.

2. The method according to claim 1, wherein the modified colour set-point is selected at the crossing of the opposite direction and the MacAdam ellipse.

3. The method according to claim 1, wherein the colour shift direction is determined based on the coordinates of the plurality of LED and the coordinates of the desired colour set-point in the CEI chromaticity diagram.

4. The method according to claim 3, wherein the colour shift direction is based on the coordinates of the LED of the plurality of LED that are closest to the coordinates of the desired colour set-point in the CEI chromaticity diagram and the coordinates of the desired colour set-point.

5. The method according to claim 1, wherein the colour shift direction is further based on a thermal characteristic of at least one of the plurality of LEDs.

6. The method according to claim 1, wherein the colour shift direction is further based on an aging characteristic of at least one of the plurality of LEDs.

7. The method according to claim 1, wherein the step of controlling the plurality of LEDs based on the modified colour set-point comprises:
   determining a required supply current for each of the plurality of LEDs so as to achieve the modified colour set-point and
   supplying the required supply currents to the plurality of LEDs by an LED driver.

8. The method according to claim 7, wherein the colour shift direction is further based on a dimming characteristic of the LED driver.

9. An LED driver configured to power a plurality of LEDs having a different colour or colour spectrum, the LED driver comprising:
   a power converter configured to supply power to the plurality of LEDs and
   a control unit, the control unit comprising:
      an input terminal configured to receive an input signal representing a desired colour set-point;
      a processing unit configured to:
   determine a MacAdam ellipse for the desired colour set-point;
   determine a required intensity or current for each of the plurality of LEDs so as to achieve the desired colour set-point;
   determine a colour shift direction for the colour set-point, based on the determined required intensities or currents;
   select a modified colour set-point based on the colour shift direction and the MacAdam ellipse, in an opposite direction from the colour shift direction;
   determine a required supply current for each of the plurality of LEDs so as to achieve the modified colour set-point;
   determine a control signal for the power converter so as to generate the required supply currents;
   and wherein the control unit further comprises an output terminal for outputting the control signal to the power converter.

10. The LED driver according to claim 9, wherein the processing unit is configured to determine the modified colour set-point at the crossing of the opposite direction and the MacAdam ellipse.

11. The LED driver according to claim 9, wherein the processing unit is configured to determine the colour shift direction based on the coordinates of the plurality of LEDs and the coordinates of the desired colour set-point in the CEI chromaticity diagram.

12. The LED driver according to claim 9, wherein the processing unit is configured to determine the colour shift direction based on a thermal characteristic of at least one of the plurality of LEDs.

13. The LED driver according to claim 9, wherein the processing unit is configured to determine the colour shift direction based on an aging characteristic of at least one of the plurality of LEDs.

* * * * *